United States Patent [19]

Nicol

[11] Patent Number: 4,572,124

[45] Date of Patent: Feb. 25, 1986

[54] PILOT INJECTION DEVICE

[75] Inventor: Stuart W. Nicol, London, England

[73] Assignee: Lucas Industries Public Limited Company, Birmingham, England

[21] Appl. No.: 651,268

[22] Filed: Sep. 17, 1984

[30] Foreign Application Priority Data

Oct. 1, 1983 [GB] United Kingdom ..... 8326356

[51] Int. Cl.[4] ..... F02M 45/04

[52] U.S. Cl. ..... 123/300; 123/459; 123/460

[58] Field of Search ..... 123/299, 300, 459, 460, 123/446, 506

[56] References Cited

U.S. PATENT DOCUMENTS

| | | | |
|---|---|---|---|
| 3,387,597 | 6/1968 | Wirsching | 123/506 |
| 3,438,359 | 4/1969 | Thoma | 123/300 |
| 3,481,315 | 12/1969 | Thornber | 123/459 |
| 4,289,098 | 9/1981 | Norberg et al. | 123/300 |
| 4,389,987 | 6/1983 | Frankle et al. | 123/300 |

FOREIGN PATENT DOCUMENTS

| | | |
|---|---|---|
| 810456 | 3/1959 | United Kingdom . |
| 1084067 | 9/1967 | United Kingdom . |
| 1125029 | 8/1968 | United Kingdom . |

*Primary Examiner*—Magdalen Y. C. Moy

[57] ABSTRACT

A fuel injection system for an internal combustion engine includes a high pressure injection pump which supplies fuel in timed relationship with an associated engine to an injection nozzle of the engine. A pilot injection device is included in the fuel circuit to the nozzle and includes a shuttle slidable in a cylinder with one end of the cylinder being connected to the pump and the other end to the nozzle. A spring biases the shuttle towards stop means at the one end of the cylinder. In the wall of the cylinder is a pair of spaced ports the first port communicating with a low pressure source and the second port with the pump. The shuttle has a pair of spaced grooves each communicating with the other end of the cylinder. In use, when the pump delivers fuel the shuttle starts to move and displaces fuel to the nozzle until the first groove communicates with the first port. While this communication is established no fuel is supplied to the nozzle and the pressure at the nozzle is reduced. During continued movement of the shuttle the aforesaid communication is broken and fuel supply to the nozzle is re-established, the shuttle continuing to move until the second groove communicates with the second port.

3 Claims, 1 Drawing Figure

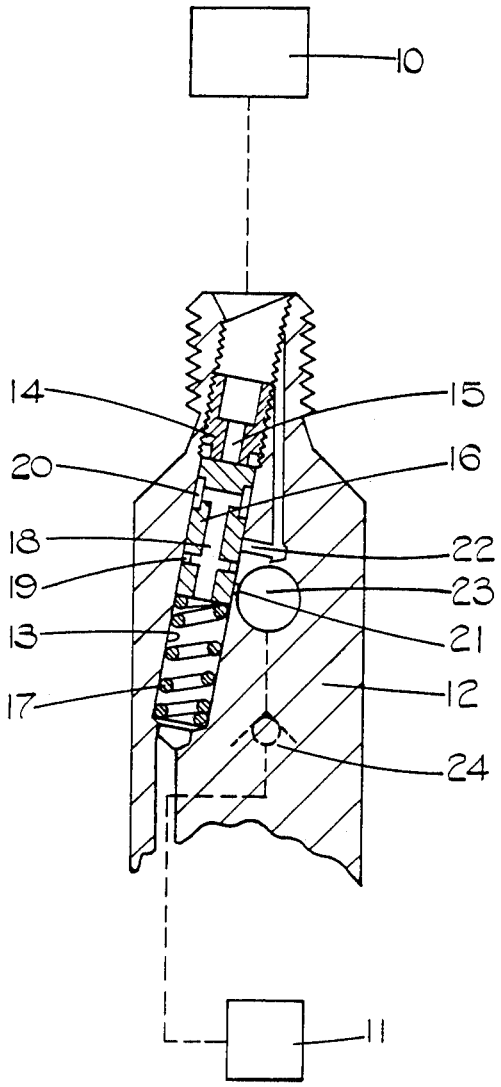
10
14
15
20
16
18
22
19
23
13
21
17
12
24
11

PILOT INJECTION DEVICE

This invention relates to a fuel injection system for supplying fuel to a compression ignition engine and comprising a high pressure fuel pump for supplying fuel in timed relationship with the associated engine and a fuel injection nozzle to which fuel is supplied by the pump, the nozzle incorporating a resiliently loaded fuel pressure operable valve member which controls fuel flow from a nozzle inlet to an outlet of the nozzle.

In order to minimise the generation of noise it is known to divide the total quantity of fuel to be injected to the combustion space of an engine into a small pilot volume and a main volume, the flow of fuel to the combustion space being interrupted between the delivery of the two volumes. The pilot volume of fuel is ignited in the engine combustion space before the main volume of fuel is ignited and the result is a more gradual increase in the pressure in the engine cylinder and a reduction in engine noise.

Fuel systems of the kind specified are known in which there is incorporated into the high pressure fuel connection between the pump and the nozzle outlet a device including a piston or shuttle member slidable in the cylinder the action of the device being to interrupt the flow of fuel through the nozzle outlet during delivery of fuel by the pump so as to divide the total volume of fuel into the so-called pilot and main volumes.

In one arrangement as seen in British Patent Specification No. 1,125,029 the cylinder at one end is connected to the outlet of the pump and at its opposite end by way of a restrictor to a drain. The piston is biased by a spring towards the one end of the cylinder and the initial flow of fuel to the nozzle takes place by way of a passage in the piston connecting the one end of the cylinder to a groove on the piston and through a restricted port in the wall of the cylinder to the nozzle. After an initial movement of the piston the restricted port is covered so as to halt further supply of fuel until after further movement of the piston, an unrestricted port connected to the nozzle is uncovered and the main volume of fuel is delivered. This arrangement has two disadvantages the first of which is that the pilot volume of fuel cannot be precisely controlled. It depends on the degree of restriction offered by the aforesaid port, the degree of restriction to the flow of liquid from the other end of the cylinder and the force exerted by the spring. Adjustment is provided for the spring force to enable the volume to be varied but it is not thought that the range of adjustment will be such as to enable the device to be applied to a wide range of systems. The second disadvantage is that at the end of the delivery of the pilot volume of fuel the closure of the valve member of the nozzle will not be assisted by the customary reduction of the fuel pressure at the nozzle.

British Specification Nos. 810456 and 1084067 show arrangements in which the other end of the cylinder containing the piston is connected to the nozzle and after a predetermined movement of the piston the one end of the cylinder is connected to a drain by a groove on the piston. This terminates the delivery of fuel and also lowers the pressure at the nozzle so that rapid and proper closure of the valve member of the nozzle takes place. Neither shows any adjustment for the initial volume quantity and in order to alter the device to suit another application it would be necessary to change at least the piston.

The object of the invention is to provide a fuel injection system of the kind specified in an improved form.

According to the invention a fuel injection system of the kind specified comprises in or adjacent to the inlet of the nozzle, means defining a cylinder, one end of the cylinder communicating with the high pressure fuel pump and the other end of the cylinder communicating with said inlet of the nozzle, a shuttle slidable in the cylinder, an adjustable stop at said one end of the cylinder, resilient means biasing the shuttle into contact with said stop, first and second passage means opening onto the periphery of the shuttle at axially spaced positions, said first and second passage means communicating with said other end of the cylinder, first and second axially spaced ports formed in the wall of said cylinder for communication with said first and second passage means respectively during movement of the shuttle against the action of the spring, said first port communicating with a low pressure source and the second port communicating with the high pressure fuel pump, the arrangement being such that during the initial delivery of fuel by the fuel pump, the shuttle will be displaced in the cylinder against the action of said resilient means and fuel will be displaced to the nozzle, and after a predetermined movement of the shuttle said first passage means will be brought into register with said first port thereby to reduce the pressure in the other end of the cylinder and to interrupt the flow of fuel to the injection nozzle, the shuttle continuing to move as the output pressure developed by the high pressure pump increases, until said first passage means moves out of register with said first port, whereafter fuel supply to the nozzle is restored, the movement of the shuttle being halted when the second passage means is brought into register with the second port, the shuttle returning into contact with the stop under the action of the resilient means, when the supply of fuel by the high pressure pump ceases, the axial setting of the stop determining the pilot volume of fuel supplied to the nozzle.

An example of a fuel system in accordance with the invention will now be described with reference to the accompanying drawing which shows the system in diagrammatic form.

Referring to the drawing the fuel system includes a high pressure fuel injection pump 10 which can be of the reciprocable plunger type which is operated in timed relationship with the associated engine. The system also includes a fuel injection nozzle 11 disposed to direct fuel into a combustion space of the associated engine. The high pressure outlet of the pump 10 is connected to the inlet of the injection nozzle and the latter includes as is well known in the art, a valve member which is biased to a closed position but which can be opened by fuel under pressure supplied to the inlet of the nozzle, to permit fuel flow through an outlet of the nozzle.

Interposed between the injection pump and the nozzle and conveniently as is shown, located in the body 12 of the fuel injection nozzle, is a cylinder 13 one end of which communicates with the outlet of the high pressure pump 10 and the other end of which communicates with the inlet of the nozzle. Conveniently the aforesaid one end of the cylinder is closed by adjustable stop in the form of an insert 14 which is in screw thread engagement with the wall of the cylinder and which is provided with a central passage 15 through which fuel flows from the pump 10. Slidable within the cylinder is a shuttle 16 and the shuttle is loaded by a low rate coiled compression spring 17 towards the insert 14.

Formed in the shuttle 16 is a blind bore 18 which extends from the end of the shuttle remote from the insert, towards the insert. Moreover, formed in the peripheral surface of the shuttle are first and second axially spaced circumferential grooves 19, 20 which communicate with the blind bore 18 by way of cross drillings.

Formed in the wall of cylinder 13 are first and second ports 21, 22, the ports being axially spaced. The port 21 communicates with a drain passage 23 which in use, is connected to a source of fuel at a low pressure. Conveniently this source of fuel may be the outlet of a low pressure pump (not shown) which supplies fuel to the high pressure pump 10. The port 22 communicates with a passage formed in the body 12 and which communicates with the outlet of the high pressure pump 10.

In operation, and starting from the rest position in which the shuttle is shown, when the pump 10 starts to deliver fuel the fuel pressure acting on the end of the shuttle remote from the spring, urges the shuttle against the action of the spring and fuel is displaced towards the nozzle 11. This flow of fuel continues until the circumferential groove 19 moves into register with the port 21 and when this communication is established the fuel instead of flowing towards the nozzle, flows to drain by way of the groove 19 and the port 21. Moreover, the pressure of fuel at the inlet of the nozzle falls and the valve member of the nozzle moves quickly to its closed position. The shuttle however continues to move and the groove 19 moves out of communication with the port 21 so that flow of fuel towards the nozzle can recommence. The extent of movement of the shuttle against the action of the spring is limited by the fact that the groove 20 moves into register with the port 22 and the remaining fuel flow takes place by way of the port 22, the groove 20 and the bore 18. The shuttle movement may however be positively limited using a mechanical stop.

When the flow of fuel from the high pressure pump ceases the shuttle is returned into contact with the insert at the one end of the cylinder by the action of the spring 17. Free movement of the shuttle under the action of the spring is allowed by the fact that a non-return valve 24 connected between the other end of the cylinder and the passage 23 opens to permit fuel flow into the portion of the cylinder which contains the spring. The extent of return movement of the shuttle is determined by its abutment with the insert 14 and the axial setting of the insert can be varied to adjust the pilot volume of fuel. Adjustment to the insert has little effect upon the force applied to the shuttle by the spring since a low rate spring is employed. A locking member (not shown) may be provided to lock the insert against rotation once adjustment has been effected and it will be noted that the adjustment of the insert can be effected through the high pressure fuel connection to the pump.

I claim:

1. A fuel injection system for supplying fuel to a compression ignition engine and comprising a high pressure fuel pump for supplying fuel in timed relationship with the associated engine and a fuel injection nozzle incorporating a resiliently loaded fuel pressure operable valve member which controls fuel flow from a nozzle inlet to an outlet of the nozzle, means defining a cylinder adjacent to the inlet of the nozzle, one end of the cylinder communicating with the high pressure fuel pump and the other end of the cylinder communicating with said inlet of the nozzle, a shuttle slidable in the cylinder, an insert in screw thread engagement within an inlet into said one end of the cylinder, said insert being adjustable through said last named inlet, resilient means biasing the shuttle into contact with said insert, first and second passage means opening onto the periphery of the shuttle at axially spaced positions, said first and second passage means communicating with said other end of the cylinder, first and second axially spaced ports formed in the wall of said cylinder for communication with said first and second passage means respectively during movement of the shuttle against the action of the spring, said first port communicating with a low pressure source and the second port communicating with the high pressure fuel pump, and a non-return valve interposed between said other end of the cylinder and said low pressure source, said non-return valve being arranged to allow fuel flow into said other end of the cylinder during movement of the shuttle under the action of the resilient means, the arrangement being such that during the initial delivery of fuel by the fuel pump, the shuttle will be displaced in the cylinder against the action of said resilient means and fuel will be displaced to the nozzle, and after a predetermined movement of the shuttle said first passage means will be brought into register with said first port thereby to reduce the pressure in the other end of the cylinder and to interrupt the flow of fuel to the injection nozzle, the shuttle continuing to move as the output pressure developed by the high pressure pump increases, until said first passage means moves out of register with said first port, whereafter fuel supply to the nozzle is restored, the movement of the shuttle being halted when the second passage means is brought into register with the second port, the shuttle returning into contact with the insert under the action of the resilient means, when the supply of fuel by the high pressure pump ceases, the axial setting of the insert determining the pilot volume of fuel supplied to the nozzle.

2. A system according to claim 1 in which said first and second passage means comprise circumferential grooves respectively on the periphery of the shuttle.

3. A system according to claim 1 in which said resilient means comprises a low rate coiled compression spring.

* * * * *